US006320550B1

(12) United States Patent
Van Voorhies

(10) Patent No.: US 6,320,550 B1
(45) **Date of Patent: *Nov. 20, 2001**

(54) CONTRAWOUND HELICAL ANTENNA

(75) Inventor: Kurt L. Van Voorhies, DeTour Village, MI (US)

(73) Assignee: VorteKx, Inc., DeTour Village, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/285,987

(22) Filed: Apr. 5, 1999

Related U.S. Application Data

(60) Provisional application No. 60/080,781, filed on Apr. 6, 1998.

(51) Int. Cl.[7] ..... H01Q 11/12

(52) U.S. Cl. ..... 343/742; 343/744; 343/866; 343/895

(58) Field of Search ..... 343/742, 743, 343/744, 748, 866, 867, 868, 895, 878, 787, 788; H01Q 11/12

(56) References Cited

U.S. PATENT DOCUMENTS

| | | | |
|---|---|---|---|
| 1,792,964 | 2/1931 | Brooks et al. | 343/872 |
| 2,740,113 | 3/1956 | Hemphill | 343/787 |

(List continued on next page.)

FOREIGN PATENT DOCUMENTS

| | | | |
|---|---|---|---|
| 548541 | 12/1985 | (AU) | H01Q/7/00 |
| 1186049 | 4/1985 | (CA) | 351/45 |
| 0043591A1 | 7/1981 | (EP) | H01Q/11/08 |
| 63-940 A | 1/1988 | (JP) . | |

OTHER PUBLICATIONS

Dec. 15, 1994; VanVoorhies, K.L.; *The Segmented Bifilar Contrawound Toroidal Helical Antenna,* vol. I–III, Ph.D. Dissertation, 1993 (Abstract published by UMI, Ann Arbor, Michigan, U.S.A., on Dec. 15, 1994 in.

Vol. 55, Issue 6B of Dissertation Abstracts; included in IDS to U.S. application Ser. No. 08/514,609 filed on Aug. 14, 1995 that issued as U.S. Patent 5,734,353 on Mar. 31, 1998; Released for publication by UMI on Feb. 3, 1999, #9427995).

1993; Bowman, D.F.; "Impedance Matching and Broadbanding" in Johnson, R.C. ed., *Antenna Engineering Handbook,*McGraw–Hill, pp. 43–1 through 43–32.

(List continued on next page.)

*Primary Examiner*—Don Wong
*Assistant Examiner*—Hoang Nguyen
(74) *Attorney, Agent, or Firm*—Kurt L. VanVoorhies

(57) ABSTRACT

A contrawound helical antenna produces a uniformly directed circulation of magnetic current with a plurality of magnetic dipole elements. In one embodiment, the magnetic dipole elements have the same curvature, and the magnetic currents on respective magnetic dipole elements are each directed in the same direction, relative to the central signal coupler of the magnetic dipole antenna. In another embodiment, the magnetic dipole elements have the opposite curvature, and the magnetic currents on respective magnetic dipole elements are each directed in opposite directions, relative to the central signal coupler of the magnetic dipole antenna.

25 Claims, 7 Drawing Sheets

U.S. PATENT DOCUMENTS

| | | | | |
|---|---|---|---|---|
| 2,798,183 | | 7/1957 | Sensiper | 315/3.5 |
| 2,836,758 | | 5/1958 | Chodorow | 315/3.6 |
| 2,853,642 | | 9/1958 | Birdsall et al. | 315/3.5 |
| 2,869,020 | | 1/1959 | Sensiper | 315/3.5 |
| 2,885,641 | | 5/1959 | Birdsall et al. | 333/157 |
| 2,911,555 | | 11/1959 | Sensiper et al. | 315/3.5 |
| 2,937,311 | | 5/1960 | Chodorow | 315/3.6 |
| 2,947,000 | * | 7/1960 | Marston et al. | 343/895 |
| 2,957,103 | | 10/1960 | Birdsall | 315/3.6 |
| 3,011,085 | | 11/1961 | Caldwell, Jr. | 315/3.5 |
| 3,069,588 | | 12/1962 | Skowron et al. | 315/3.6 |
| 3,181,090 | | 4/1965 | Ash | 333/156 |
| 3,322,996 | | 5/1967 | Schrager | 315/3.5 |
| 3,343,089 | | 9/1967 | Murphy et al. | 455/123 |
| 3,436,594 | | 4/1969 | Farney | 315/39.77 |
| 3,509,465 | | 4/1970 | Andre et al. | 455/282 |
| 3,573,833 | | 4/1971 | Ajioka et al. | 343/753 |
| 3,629,937 | | 12/1971 | Fredriksson et al. | 29/600 |
| 3,646,562 | | 2/1972 | Acker et al. | 343/720 |
| 4,004,179 | | 1/1977 | Phillips | 315/3.5 |
| 4,008,478 | | 2/1977 | Ikrath et al. | 343/720 |
| 4,017,863 | | 4/1977 | Tharp et al. | 343/719 |
| 4,622,558 | * | 11/1986 | Corum | 343/742 |
| 4,751,515 | | 6/1988 | Corum | 343/742 |
| 4,890,115 | | 12/1989 | Hartings | 343/742 |
| 5,220,340 | | 6/1993 | Shafai | 343/895 |
| 5,313,216 | | 5/1994 | Wang et al. | 343/700 MS |
| 5,317,233 | | 5/1994 | Lien et al. | 315/5.37 |
| 5,351,063 | | 9/1994 | Kim et al. | 343/895 |
| 5,442,369 | * | 8/1995 | Van Voorhies et al. | 343/742 |
| 5,621,422 | | 4/1997 | Wang | 343/895 |
| 5,654,723 | * | 8/1997 | Craven et al. | 343/742 |
| 5,734,353 | * | 3/1998 | Van Voorhies | 343/742 |
| 5,952,978 | | 9/1999 | VanVoorhies | 343/742 |

OTHER PUBLICATIONS

1993; DuHamel, Raymond H.; Scherer, James P.; "Frequency–Independent Antennas" in Johnson, R.C. ed., *Antenna Engineering Handbook,* McGraw–Hill, pp. 14–1 through 14–32.

Kandoian, A. G.;Sichak, W., "Wide–Frequency–Range Tuned Helical Antennas and Circuits", Convention Record of the IRE, 1953 National Convention, Part 2 –Antennas and Communications, 1953, pp. 42–47.

Birdsall, C. K., Everhart, T. E., "Modified Contra–Wound Helix Circuits for High–Power Traveling Wave Tubes," IRE Transactions on Electron Devices, ED–3, Oct. 1956, pp. 190–204.

Nevins, J. E., Jr., "An Investigation and Application of the Contrawound Helix," IRE Transaction on Electron Devices, ED–6, 1959, 195–202.

Ham, J. M.; Slemon, G. R., "Time Varying Electric and Magnetic Fields," Scientific Basis of Electrical Engineering, John Wiley & Sons, N.Y., 1961, pp. 303–305.

Harrington, R. F., Time Harmonic Electromagnetic Fields, McGraw Hill, N.Y., U.S.A., 1961, pp. 106–111.

Corum, J. F.; Corum, K. L., "Toroidal Helix Antenna," 1987 IEEE AP–S International Symposium Digest, Jun. 15th–19th, 1987, pp. 832–835 (note: pp. 833–834 missing).

Pinzone, B. F.; Corum, J. F.; Corum, K. L., "A New Low Profile Anti–Skywave Antenna for AM Broadcasting," 1988 NAB Engineering Conference Proceedings, 42nd Engineering Conference, Las Vegas, Nevada, Apr. 1988. pp. 7–15.

Tiberio, C. A.; Raganella, L.; Banci, G.; Franconi, C., "The RF Toroidal Transformer as a Heat Delivery System for Regional and Focused Hyperthermia," EEE Transactions on Biomedical Engineering, 35, 12 (Dec. 1988), pp. 1077–1085.

VanVoorhies, K. L., The Segmented Bifilar Contrawound Toroidal Helical Antenna, vol. I–III, Ph.D. Dissertation, 1993 (Abstract published by UMI, Ann Arbor, Michigan, U.S.A., on Dec. 15, 1994 in vol. 55, Issue 6B of Dissertation Abstracts; Released for publication by UMI on Feb. 3, 1999, #9427995).

* cited by examiner

CONTRAWOUND HELICAL ANTENNA

CROSS-REFERENCE TO RELATED APPLICATIONS

The instant application claims the benefit of prior U.S. Provisional Application Serial No. 60/080,781 filed on Apr. 06, 1998.

The instant invention is related in subject matter to patent application Ser. No. 08/514,609 entitled Contrawound Toroidal Helical Antenna filed on Aug. 14, 1995 now U.S. Pat. No. 5,743,353, which is incorporated herein by reference.

TECHNICAL ART

The instant invention generally relates to antennas for transmitting and receiving electromagnetic radiation, and more particularly to contrawound helical antennas.

BACKGROUND OF THE INVENTION

Application Ser. No. 08/514,609, the '609 Application, teaches an electrically small contrawound toroidal helical antenna (CTHA) comprising a single conductor with two length portions in overlapping contrawound relationship to one another. Electrical currents in the individual length portions travel in opposite circumferential directions around the toroid, so that the net circumferential electric current around the toroid is effectively zero. However, because of the contrawound helical relationship, the associated circumferential magnetic current components created by the respective electric current components in each of the toroidal helical length portions reinforce, so that the resulting radiation pattern is similar to that of an electric dipole coincident with and centered along the major axis of the torus. In other words, the resulting radiation pattern is strongly linearly polarized in a direction parallel to the major axis of the toroid. Depending upon the construction of the antenna, particularly the aspect ratio of the underlying torus form and the number of helical turns, other polarization components may also be present.

The '609 Application, incorporated by reference herein, teaches a schematic symbolism for representing generalized helical and generalized toroidal helical windings as solid or dashed lines, the former representing a left had pitch sense, the later representing a right hand pitch sense, wherein the axial direction of the associated magnetic current and the projected axial direction of the associated electric current are the same for a right hand pitch sense helix, and opposite for a left-hand pitch sense helix. The radiation pattern of an electromagnetic antenna can be related to the effective electric and magnetic current distributions created by the antenna. For example, a uniform ring of magnetic current with no associated electric currents corresponds to the radiated electromagnetic field distribution of an electric dipole antenna. Furthermore, a uniform ring of electric current with no associated magnetic currents approximates the radiation pattern of a "Smith Cloverleaf" antenna. The radiation pattern for a particular set of current distributions can be determined by either simulation or measurement.

In an exemplary mode of operation, the antenna is operated at a frequency such that the circumferential length of the antenna is one half of an electrical wavelength. The slow wave properties of the contrawound helix make the corresponding physical length shorter than the free space wavelength according to the associated velocity factor, which depends upon the associated underlying helix geometry.

One limitation of the above described contrawound toroidal helical antenna is that the bandwidth of the antenna is about 10%. Accordingly, for broadband applications for which a greater bandwidth is required, a plurality of contrawound toroidal helical antennas are necessary wherein the respective resonant frequencies of the antennas are separated from one another in such a manner that for a given frequency of operation within the associated frequency band, the one of the plurality of antennas having the lowest VSWR at the transmission line side of the associated impedance matching network is used for transmitting or receiving the given signal. Accordingly, as illustrated in FIG. 76 of the '609 Application, a broadband signal may be directed to or extracted from the appropriate antenna using a multiplexer. In another embodiment, individual transceivers could be adapted to each antenna element. In yet another embodiment, a multiplexer may be used to interface one transmitter with a plurality of antenna elements, and individual receivers may be operatively coupled to each of the antenna elements, the outputs from which are combined so as to form a composite received signal.

As illustrated in the above referenced FIG. 76, the individual antenna elements are concentrically co-located about a common central axis. This has the advantage of providing for phase symmetry of the resulting transmitted waves with respect to the common axis. However, one problem with this arrangement is that transmission line sides of the respective impedance matching networks cannot be interconnected to a common signal port without incorporating transmission line segments between one or more of the impedance matching networks and the common signal port because of the physical separation between the antenna elements. These transmission line segments introduce phase delays in the signal that are a function of frequency, which precludes the direct interconnection of the transmission line sides of the respective impedance matching networks so as to achieve natural broadband operation a the common signal port.

Another limitation of the above described contrawound toroidal helical antenna is that the antenna input impedance is generally significantly different from the characteristic impedance of typical transmission lines, which therefore requires the use of an associated impedance matching network in the signal connector. More particularly, for a relatively wide bandwidth resonance condition, the input impedance of the antenna is generally from 1 to 3 KΩ. By contrast, typical transmission lines have an impedance of 50–300Ω.

SUMMARY OF THE INVENTION

The instant invention overcomes the above-noted problems by providing a magnetic dipole antenna shaped so as to produce a uniformly directed circulation of magnetic current by each of the associated magnetic dipole elements, thereby causing a radiation pattern similar to the contrawound toroidal helical antenna of the '609 Application. In one elementary embodiment, the magnetic dipole antenna is antisymmetric, for example "S" or "Z" shaped, wherein the magnetic currents on respective magnetic dipole elements are each directed in the same direction relative to the center of the magnetic dipole antenna. In another elementary embodiment, the magnetic dipole antenna is symmetric, for example circularly shaped, wherein the magnetic currents on respective magnetic dipole elements are each directed in opposite directions relative to the center of the magnetic dipole antenna. In yet another elementary embodiment, a magnetic monopole antenna comprises a single magnetic dipole element arranged so as to generate a circulation of the magnetic current.

The magnetic dipole elements comprise a variety of contrawound helical structures, either parallel/transmission line fed or series/loop fed; either electrically open or electrically closed.

A plurality of elementary magnetic dipole antenna elements may be combined in a magnetic dipole antenna system. If each of the elementary magnetic dipole antenna elements in a plurality is tuned for the same operating frequency and are characterized by a relatively high input impedance at the operating frequency, then the combination thereof provides for a lower composite input impedance that is easier to match to a transmission line. If each of the elementary magnetic dipole antenna elements in a plurality is tuned for a different operating frequency and is characterized by a relatively high input impedance at the operating frequency, then the combination thereof provides for a relatively broad bandwidth antenna that can be readily adapted to a single signal port.

Accordingly, one object of the instant invention is to provide an improved magnetic antenna that creates a circulation of magnetic current.

A further object of the instant invention is to provide a relatively small, low profile antenna that is polarized along the direction of magnetic circulation A yet further object of the instant invention is to provide an improved contrawound helical antenna having an associated input impedance that is closer to the impedance of conventional transmission lines.

A yet further object of the instant invention is to provide an improved broadband contrawound helical antenna system.

These and other objects, features, and advantages of the instant invention will be more fully understood after reading the following detailed description of the preferred embodiment with reference to the accompanying drawings and viewed in accordance with the appended claims.

DETAILED DESCRIPTION OF THE PREFERRED EMBODIMENT(S)

Figure 1:
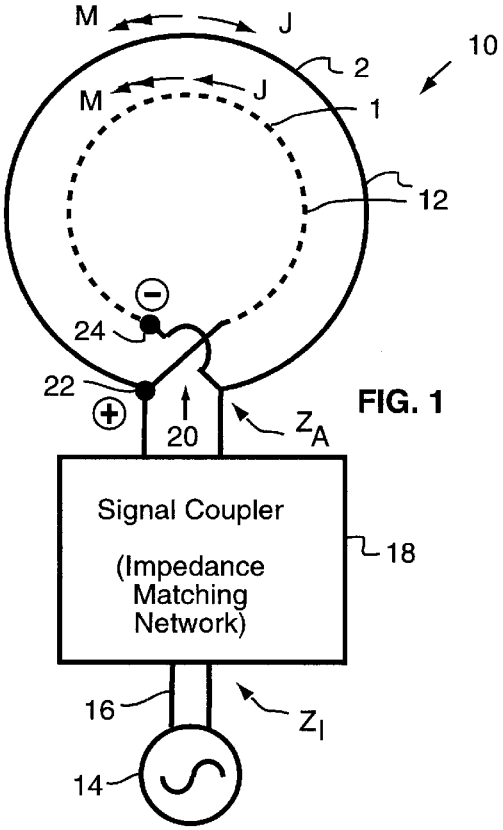
FIG. 1 is a schematic diagram of a contrawound toroidal helical antenna in accordance with the '609 Application.

Referring to FIG. 1, a contrawound toroidal helical antenna 10 comprises a single conductor 12 having two length portions 1,2, each substantially the same length, both together comprising a generalized contrawound toroidal helix wherein each length portion forms a generalized toroidal helix of uniform helical pitch sense and the helical pitch senses of the different length portions are opposite one another. In the schematic illustration of FIG. 1, the dashed line of length portion 1 represents a right-hand helical pitch sense helical conductor for which the direction of magnetic current is the same as the axial projected direction of the associated electric current in the associated generalized helix. Furthermore, the solid line of length portion 2 represents a left-hand helical pitch sense helical conductor for which the direction of magnetic current is opposite to the axial projected direction of the associated electric current in the associated generalized helix.

A signal from a signal source 14 interconnected via a transmission line 16 through signal connector 18 incorporating an impedance matching network is applied to the signal feed port 20 of the contrawound toroidal helical antenna 10, wherein the signal feed port 20 comprises first 22 and second 24 nodes that are located at the junctions of the first and second length portions 1,2 of the single conductor 12. Accordingly, for the instantaneous signal polarity as illustrated in FIG. 1, the applied signal causes electric currents J to flow in the first and second length portions 1,2 directed as shown in FIG. 1. The electric current J in the right-hand pitch sense length portion 1 creates a similarly directed magnetic current M. The electric current J in the left-hand pitch sense length portion 2 creates an oppositely directed magnetic current M. Accordingly, because the electric currents J in the first and second length portions 1,2 are oppositely directed, and therefore effectively cancel one another, the associated magnetic currents M are similarly directed and reinforce one another, so as to create a ring of magnetic current M.

Figure 2:
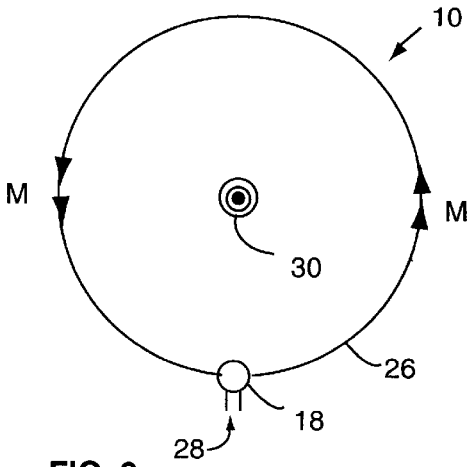
FIG. 2 is a schematic representation of the embodiment of FIG. 1 as a magnetic loop antenna.

Referring to FIG. 2, the contrawound toroidal helical antenna 10 is represented schematically as a magnetic loop antenna comprising a ring 26 of magnetic current M connected to a signal connector 18 having an input port 28. The ring 26 of magnetic current M is characterized by an associated circulation of magnetic current 30 related to the associated radiation pattern of the contrawound toroidal helical antenna 10.

Figure 3:
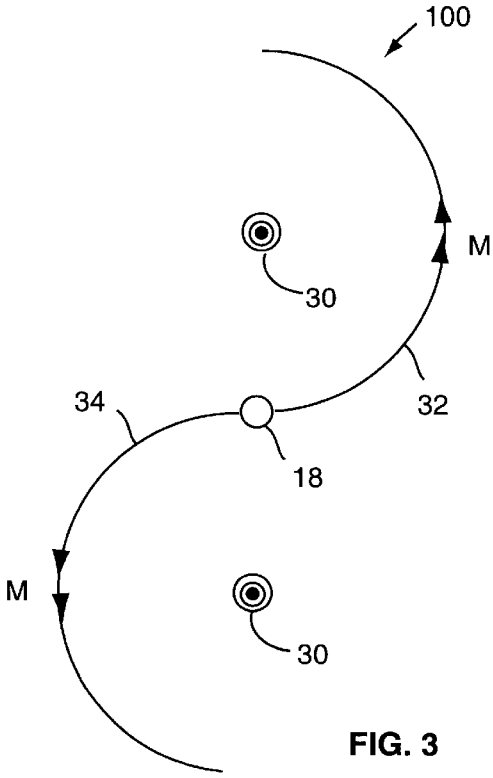
FIG. 3 is a schematic representation of a first elementary embodiment of the instant invention comprising an antisymmetric magnetic dipole antenna.

Referring to FIG. 3, in one embodiment of the instant invention, a circulation of magnetic current 30 is created by an anti-symmetric magnetic dipole antenna 100 comprising dipole elements 32, 34 connected to a central signal coupler 18, wherein at any given point in time, the magnetic current M in each magnetic dipole element 32, 34 propagates in the same direction along the respective magnetic dipole element 32, 34 relative to the central signal coupler 18. The respective magnetic dipole elements 32, 34 are shaped so as to create an associated circulation of magnetic current 30 whereby the respective directions of circulation from the respective magnetic dipole elements 32, 34 are the same.

While each magnetic dipole element 32, 34 is illustrated in FIG. 3 with a semi-circular shape, the actual shape is not considered to be limiting to the instant invention. More particularly, the shape of each element can be that of any section of a generalized toroid as defined in the '609 Application. For example, the shape of the magnetic dipole elements 32, 34 could be circular, elliptical, spiral, piecewise linear, or a spline curve. Moreover, the magnetic dipole elements 32, 34 need not necessarily reside in a plane, but can in general follow three dimensional paths.

Figure 4A:
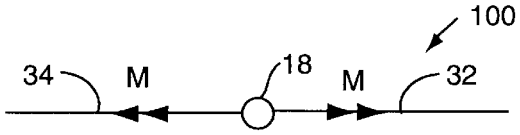
FIG. 4*a* illustrates the embodiment of FIG. 3 projected along a line.
Figure 4B:
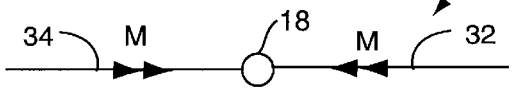
FIG. 4*b* illustrates the embodiment of FIG. 4*a* at a point in time when the signal phases are reversed with respect to that for FIG. 4*a*.

FIG. 4*a* illustrates the embodiment of FIG. 3 projected along a line, for use as a reference for illustrating associated structures and distributions of electric and magnetic currents of various embodiments of the instant invention. FIG. 4*a* illustrates the direction of magnetic current M in the associated magnetic dipole elements 32, 34 at the same instant of time as is illustrated by FIG. 3. As described in the '609 Application, magnetic current corresponds to a time varying magnetic field. FIG. 4*b* illustrates the direction of magnetic current M in the associated magnetic dipole elements 32, 34 at an instant of time when the signal phase is reversed with respect to that of FIG. 4*a*. Accordingly, FIGS. 4*a* and 4*b* illustrate the magnetic current distribution necessary to carry out the embodiment of the instant invention as illustrated by FIG. 3.

Figure 5A:
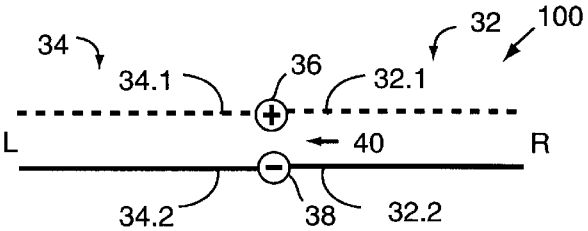
FIG. 5*a* is a schematic representation of a contrawound helical element in accordance with the embodiments of FIGS. 3, 4*a*, and 4*b*.

Referring to FIG. 5*a*, one embodiment of a contrawound helical antenna 100 in accordance with FIGS. 3, 4*a*, and 4*b* is schematically illustrated as a parallel/transmission line fed contrawound helix comprising a pair of isolated conductors. This is further illustrated in FIG. 5*b* as a pair of helical dipole antennas that are relatively contrawound with respect to one another. Each associated helical dipole antenna comprises a pair of helical dipole elements 32.1, 34.2 and 32.2, 34.1 respectively, each contrawound with respect to the other. Viewed in another way, the contrawound helical antenna 100 comprises a pair of magnetic dipole elements 32, 34. One of the magnetic dipole elements 32 comprises a contrawound helix comprising the combination of right-hand 32.1 and left-hand 32.2 pitch sense generalized helix elements. Similarly, the other of the dipole elements 34 comprises a contrawound helix comprising the combination of right-hand 34.1 and left-hand 34.2 pitch sense generalized helix elements. The magnetic dipole elements 32, 34 are fed from a signal source connected to a common pair of nodes 36, 38 comprising a signal input port 40, wherein the right-hand pitch sense helix elements 32.1, 34.1 are connected to one of the nodes 36, and the left-hand pitch sense helix elements 32.2, 34.2 are connected to the other of the nodes 38.

Figure 5B:
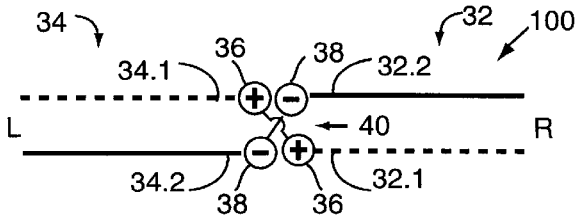
FIG. 5*b* is an equivalent schematic representation of the embodiment of FIG. 5*a* as a combination of two helical dipole elements.
Figure 7A:
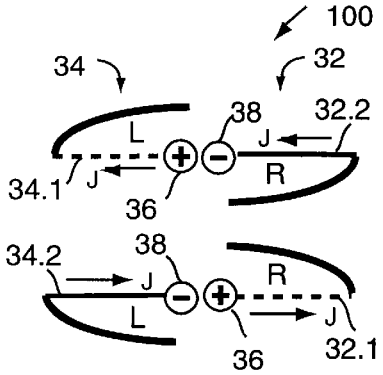
FIG. 7*a* is a representation of the electric current distribution at a given point in time for the embodiment of FIGS. 5*a* and 5*b* for a first order resonance condition.
Figure 7B:
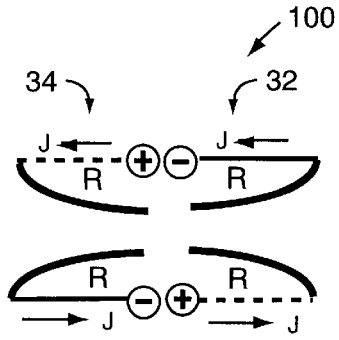
FIG. 7*b* is a representation of the electric current distribution at a given point in time for the embodiment of FIGS. 5*a* and 5*b* for a first order resonance condition, wherein the polarities are referenced to a common direction.
Figure 7C:
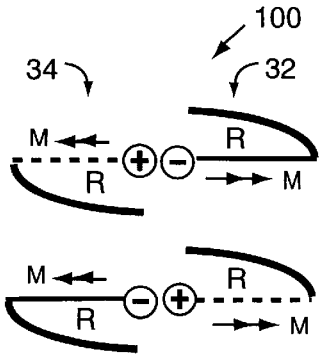
FIG. 7*c* is a representation of the magnetic current distribution at a given point in time for the embodiment of FIGS. 5*a* and 5*b* for a first order resonance condition, wherein the polarities are referenced to a common direction.

FIGS. 7*a*, 7*b*, and 7*c* illustrate the electric J and magnetic M current distributions at the associated fundamental resonant frequency for the embodiments of FIGS. 5*a*, 5*b*, overlaid upon the physical schematic of FIG. 5*b*. Referring to FIG. 7*a*, at a given instant in time, a sinusoidal positive electric current propagates leftwards from node 36 on helical dipole element 34.1, and also rightwards from node 36 on helical dipole element 32.1. Moreover, a sinusoidal negative electric current propagates leftwards from node 38 on helical dipole element 34.2, and also rightwards from node 38 on helical dipole element 32.2. Referring to FIG. 7*b* , the conductor directed electric currents of FIG. 7*a* are transformed into equivalent rightwards directed currents, whereby a negative leftwards directed current becomes a positive rightwards directed current and a positive leftwards directed current becomes a negative rightwards directed current. Finally, FIG. 7*c* illustrates the associated magnetic current M distribution corresponding to the electric current J distributions of FIGS. 7*a* and 7*b*, wherein the directions of electric J and magnetic M current are the same as one another for right-hand pitch sense helical dipole elements 32.1, 34.1 and are opposite one another for left-hand pitch sense helical dipole elements 32.2, 34.2, whereby the magnetic currents M for both helical dipole elements 32.1, 32.2 of magnetic dipole element 32 are directed in the same direction. Similarly, the magnetic currents M for both helical dipole elements 34.1, 34.2 of magnetic dipole element 34 are directed in the same direction that is opposite to the direction of magnetic current in magnetic dipole element 32. As seen in FIG. 7*b*, the electric current J components on each respective helical dipole element cancel one another. Accordingly, the magnetic dipole antenna 100 operating at the fundamental resonant frequency in accordance with the embodiment of FIGS. 5*a* and 5*b* produces an associated magnetic current M distribution in accordance with FIG. 4*a*, without an appreciable associated electric current J.

Figure 10A:
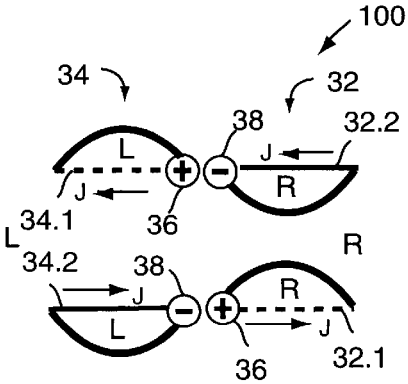
FIG. 10*a* is a representation of the electric current distribution at a given point in time for the embodiment of FIGS. 5*a* and 5*b* for a second order resonance condition.
Figure 10B:
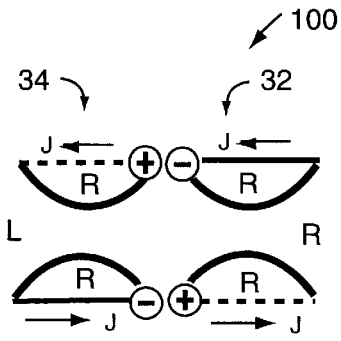
FIG. 10*b* is a representation of the electric current distribution at a given point in time for the embodiment of FIGS. 5*a* and 5*b* for a second order resonance condition, wherein the polarities are referenced to a common direction.
Figure 10C:
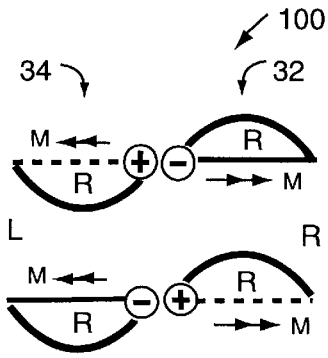
FIG. 10*c* is a representation of the magnetic current distribution at a given point in time for the embodiment of FIGS. 5*a* and 5*b* for a second order resonance condition, wherein the polarities are referenced to a common direction.

FIGS. 10*a*, 10*b*, and 10*c* illustrate the electric J and magnetic M current distributions at the associated first harmonic resonant frequency for the embodiments of FIGS. 5*a*, 5*b*, overlaid upon the physical schematic of FIG. 5*b*. As for FIGS. 7*a*, 7*b*, and 7*c* described hereinabove, the magnetic dipole antenna 100 operating at the first harmonic resonant frequency in accordance with the embodiment of FIGS. 5*a* and 5*b* produces an associated magnetic current M distribution in accordance with FIG. 4*a*, without an appreciable associated electric current J.

Figure 6:
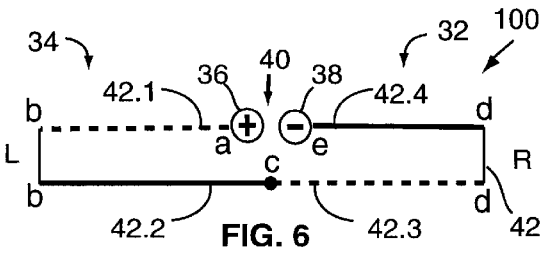
FIG. 6 is a schematic representation of another contrawound helical element in accordance with the embodiments of FIGS. 3, 4*a*, and 4*b*.

Referring to FIG. 6, another embodiment of a contrawound helical antenna 100 in accordance with FIGS. 3, 4*a*, and 4*b* is schematically illustrated as series/loop fed contrawound helix comprising a single conductor 42 constituting a pair of magnetic dipole elements 32, 34. Magnetic dipole element 32 comprises a generalized contrawound helix comprising a right-hand pitch sense helix 42.3 and a left-hand pitch sense helix 42.4, each connected to one another at the right end d. Magnetic dipole element 34 comprises a generalized contrawound helix comprising a right-hand pitch sense helix 42.1 and a left-hand pitch sense helix 42.2, each connected to one another at the left end b. End a of right-hand pitch sense helix 42.1 is connected to node 36 that is operatively coupled to one of the signal terminals. End e of left-hand pitch sense helix 42.4 is connected to node 38 that is operatively coupled to the other of the signal terminals. The remaining free ends of left-hand pitch sense helix 42.2 and right-hand pitch sense helix 42.3 are connected to one another at point c.

Figure 8:
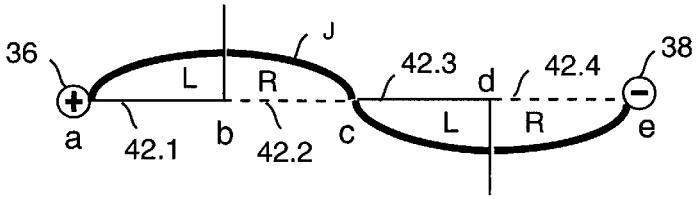
FIG. 8 is a representation of the electric current distribution at a given point in time for the embodiment of FIG. 6, wherein the associated conductor is developed along a line.

Referring to FIG. 8 that illustrating the single conductor 42 projected along a line at a given instant in time for which the sinusoidal waveform applied to nodes 36 and 38 is polarized as shown, the electric current J distribution on the single conductor 42 is a standing wave of one wavelength. The direction of the current within each quarter-wave helix element 42.1, 42.2, 42.3, and 42.4 is shown as left L or right R in accordance with the geometry of FIG. 6.

Figure 9A:
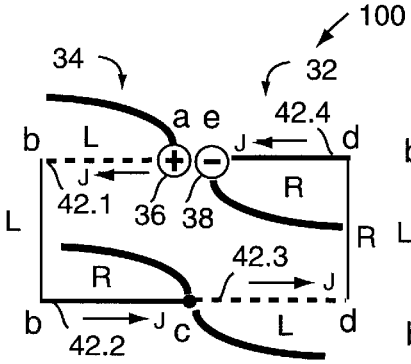
FIG. 9*a* is a representation of the electric current distribution at a given point in time for the embodiment of FIG. 6.
Figure 9B:
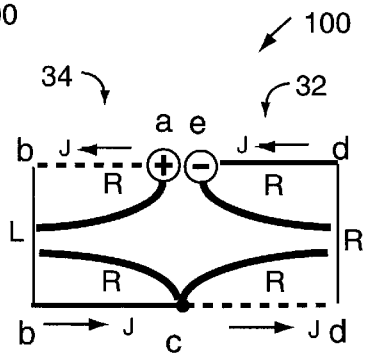
FIG. 9*b* is a representation of the electric current distribution at a given point in time for the embodiment of FIG. 6, wherein the polarities are referenced to a common direction.
Figure 9C:
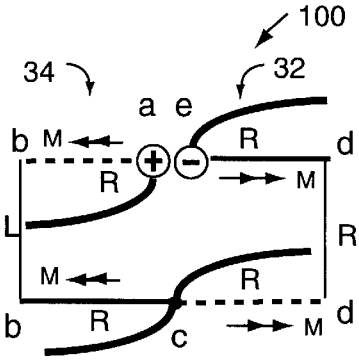
FIG. 9*c* is a representation of the magnetic current distribution at a given point in time for the embodiment of FIG. 6, wherein the polarities are referenced to a common direction.

FIGS. 9*a*, 9*b*, and 9*c* illustrate the electric J and magnetic M current distributions at the associated fundamental resonant frequency for the embodiment of FIG. 6, overlaid thereupon. Referring to FIG. 9*a*, at a given instant in time, a sinusoidal positive electric current propagates leftwards from node 36 on helix element 42.1 to point b, and then rightwards from point b on helix element 42.2 to point c, a node on the sinusoidal current distribution. Moreover, a sinusoidal negative electric current propagates rightwards from node 38 on helix element 42.4 to point d, and then leftwards from point d on helix element 42.3 to point c. Referring to FIG. 9*b*, the conductor directed electric currents of FIG. 9*a* are transformed into equivalent rightwards directed currents, whereby a negative leftwards directed current becomes a positive rightwards directed current and a positive leftwards directed current becomes a negative rightwards directed current. Finally, FIG. 9*c* illustrates the associated magnetic current M distribution corresponding to the electric current J distributions of FIGS. 9*a* and 9*b*, wherein the directions of electric J and magnetic M current are the same as one another for a right-hand pitch sense helix elements 42.1, 42.3 and are opposite one another for a left-hand pitch sense helix elements 42.2, 42.4, whereby the magnetic currents M for both helix elements 42.3, 42.4 of magnetic dipole element 32 are directed in the same direction. Similarly, the magnetic currents M for both helix elements 42.1, 42.2 of magnetic dipole element 34 are directed in the same direction that is opposite to the direction of magnetic current in magnetic dipole element 32. As seen in FIG. 9*b* , the electric current J components on each respective adjacent helix elements cancel one another. Accordingly, the magnetic dipole antenna 100 operating at the first harmonic resonant frequency in accordance with the embodiment of FIG. 6 produces an associated magnetic current M distribution in accordance with FIG. 4*a*, without an appreciable associated electric current J.

One problem with the contrawound helical antenna embodiment of FIG. 6 that operates at the first harmonic resonant frequency, and the embodiment of FIGS. 5*a*, 5*b* when operated at the first harmonic resonant frequency, is that these embodiments are twice as large as a similar antenna operated at the fundamental resonant frequency. Furthermore, the embodiment of FIG. 6 at the first harmonic resonant frequency and the embodiment of FIGS. 5*a*, 5*b* at the fundamental resonant frequency are characterized by a relatively low impedance that inherently has a lower bandwidth than relatively high impedance resonances.

Figure 11:
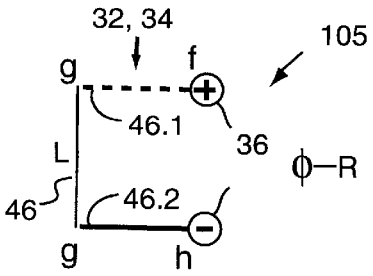
FIG. 11 is a schematic representation of a contrawound helical element in accordance with one of the two magnetic current elements in the embodiments of FIGS. 3, 4*a*, and 4*b*.
Figure 12:
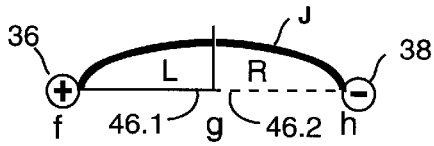
FIG. 12 is a representation of the electric current distribution at a given point in time for the embodiment of FIG. 11, wherein the associated conductor is developed along a line.
Figure 34:
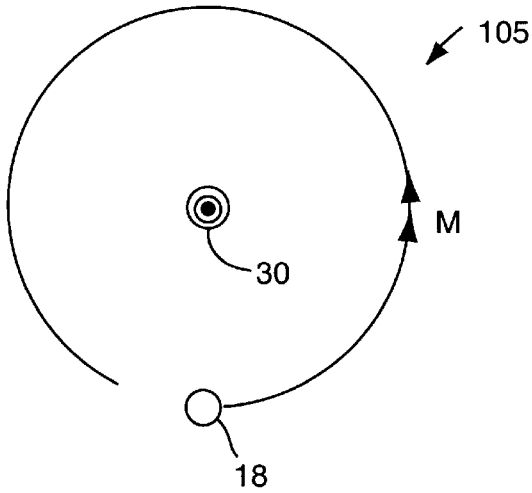
FIG. 34 illustrates a third elementary embodiment of the instant invention, comprising a signal magnetic current element in accordance with FIG. 11.

Referring to FIG. 11, a magnetic dipole element 32, 34 comprises a series/loop fed contrawound helix that is a quarter wavelength long at the fundamental resonant frequency and that is characterized by an associated relatively high impedance at this resonance. The magnetic dipole element 32, 34 of FIG. 11 either constitutes one of the two respective magnetic dipole elements 32, 34 of FIGS. 3, 4*a*, and 4*b*, or may solely constitute a contrawound helical antenna 105 as illustrated in FIG. 34. The magnetic dipole element 32, 34 of FIG. 11 comprises a single conductor 46, which is illustrated in FIG. 12 projected along a line whereupon is overlaid an associated half wavelength standing wave.

Figure 13A:
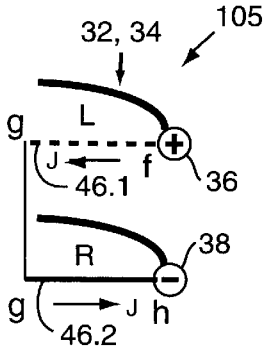
FIG. 13*a* is a representation of the electric current distribution at a given point in time for the embodiment of FIG. 11.
Figure 13B:
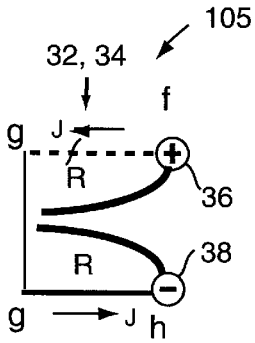
FIG. 13*b* is a representation of the electric current distribution at a given point in time for the embodiment of FIG. 11, wherein the polarities are referenced to a common direction.
Figure 13C:
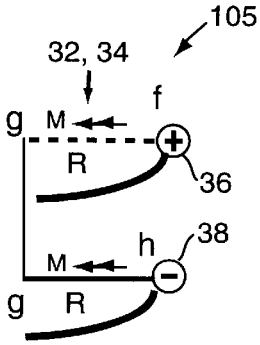
FIG. 13*c* is a representation of the magnetic current distribution at a given point in time for the embodiment of FIG. 11, wherein the polarities are referenced to a common direction.

FIGS. 13*a*, 13*b*, and 13*c* illustrate the electric J and magnetic M current distributions at the associated first harmonic resonant frequency for the embodiment of FIG. 11, overlaid upon the physical schematic of FIG. 11. As for FIGS. 7*a*, 7*b*, and 7*c* described hereinabove, the magnetic dipole element 105 operating at the fundamental resonant frequency in accordance with the embodiment of FIG. 11 produces an associated magnetic current M distribution in accordance with one of the magnetic dipole elements 32, 34 of FIG. 4*a*, without an appreciable associated electric current J.

Figure 14:
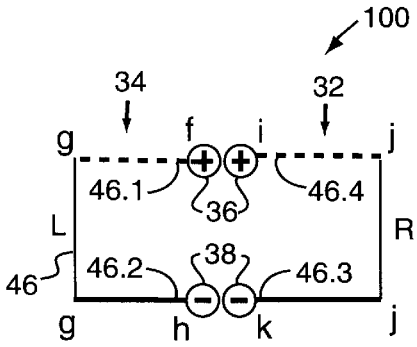
FIG. 14 is a schematic representation of yet another contrawound helical element in accordance with the embodiments of FIGS. 3, 4*a*, and 4*b*, comprising the combination two contrawound helical elements, each in accordance with the embodiment of FIG. 11.
Figure 15A:
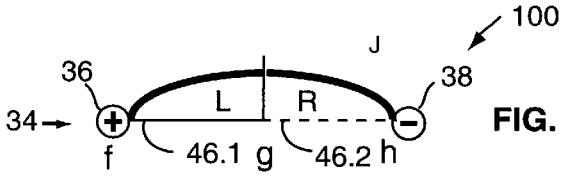
FIG. 15*a* is a representation of the electric current distribution at a given point in time for one of the contrawound helical elements in the embodiment of FIG. 14, wherein the associated conductor is developed along a line.
Figure 15B:
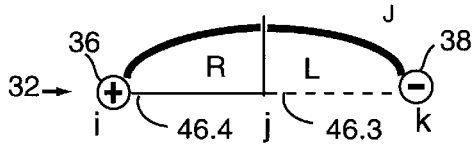
FIG. 15*b* is a representation of the electric current distribution at a given point in time for the other of the contrawound helical elements in the embodiment of FIG. 14, wherein the associated conductor is developed along a line.

Referring to FIG. 14, a pair of magnetic dipole elements 32, 34 in accordance with FIG. 11 are combined in parallel at nodes 36,38 to form a magnetic dipole antenna 100 in accordance with FIGS. 3, 4*a*, and 4*b*, comprising a single conductor formed as a contrawound helix with respective ends shorted together, whereby the signal is parallel/transmission line fed at a signal input port that is across the contrawound helix. The respective magnetic dipole elements 32, 34 are projected on respective lines in respective FIGS. 15*a* and 15*b*, upon which is overlaid the associated half-wave standing wave current distribution with the direction of associated current with respect to the magnetic dipole antenna 100 shown therewith as either left L or right R.

Figure 16A:
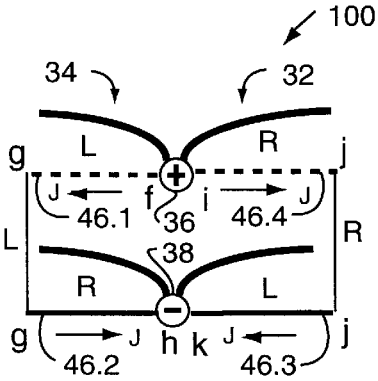
FIG. 16*a* is a representation of the electric current distribution at a given point in time for the embodiment of FIG. 14.
Figure 16B:
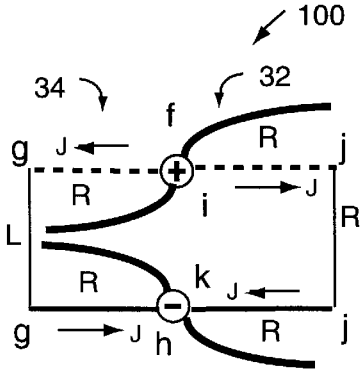
FIG. 16*b* is a representation of the electric current distribution at a given point in time for the embodiment of FIG. 14, wherein the polarities are referenced to a common direction.
Figure 16C:
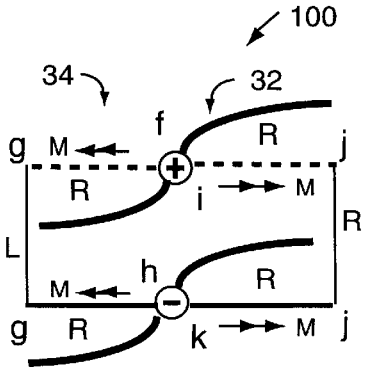
FIG. 16*c* is a representation of the magnetic current distribution at a given point in time for the embodiment of FIG. 14, wherein the polarities are referenced to a common direction.

FIGS. 16*a*, 16*b*, and 16*c* illustrate the electric J and magnetic M current distributions at the associated fundamental resonant frequency for the embodiment of FIG. 14, overlaid upon the physical schematic of FIG. 14. As for FIGS. 7*a*, 7*b*, and 7*c* described hereinabove, the magnetic dipole antenna 100 operating at the fundamental resonant frequency in accordance with the embodiment of FIG. 14 produces an associated magnetic current M distribution in accordance with FIG. 4*a*, without an appreciable associated electric current J.

Figure 17:
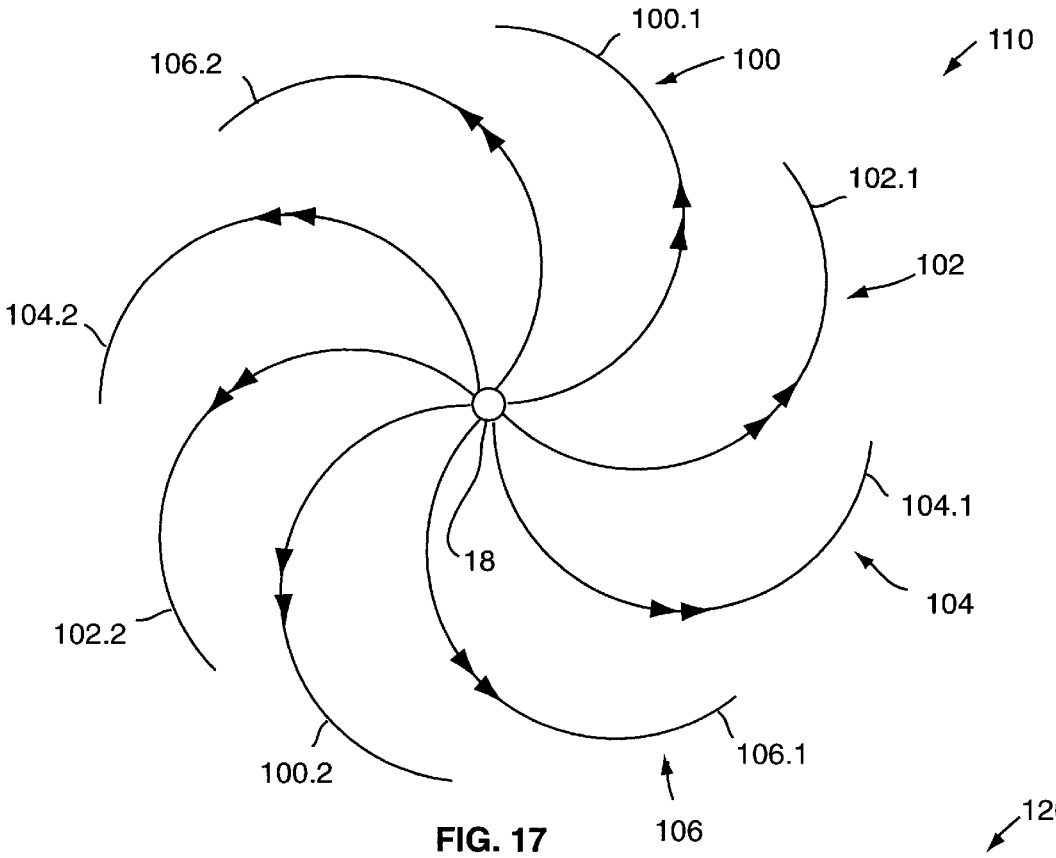
FIG. 17 illustrates another embodiment of the instant invention, comprising a plurality of magnetic current elements in accordance with FIG. 3, each having a common resonant frequency.

Referring to FIG. 17, a plurality of magnetic dipole antennas 100, 102, 104, and 106 are combined with respective signal connectors 18 connected in parallel so as to form a single antenna system 110. This embodiment has the advantage that for each respective magnetic dipole antenna 100, 102, 104, and 106 operated at a relatively high impedance at the input to the respective signal connectors 18, then the parallel combination provides for a lower overall impedance that is easier to match to the respective impedance of an associated transmission line, if such impedance matching is necessary. Whereas the embodiment illustrated in FIG. 17 is characterized by an even number of associated magnetic dipole elements 100.1, 100.2, 102.1, 102.2, 104.1, 104.2, 106.1, 106.2, the antenna system 110 may be constructed entirely of elements in accordance with FIG. 11 so as to provide any number of magnetic dipole elements—even or odd—in the antenna system 110.

Figure 18:
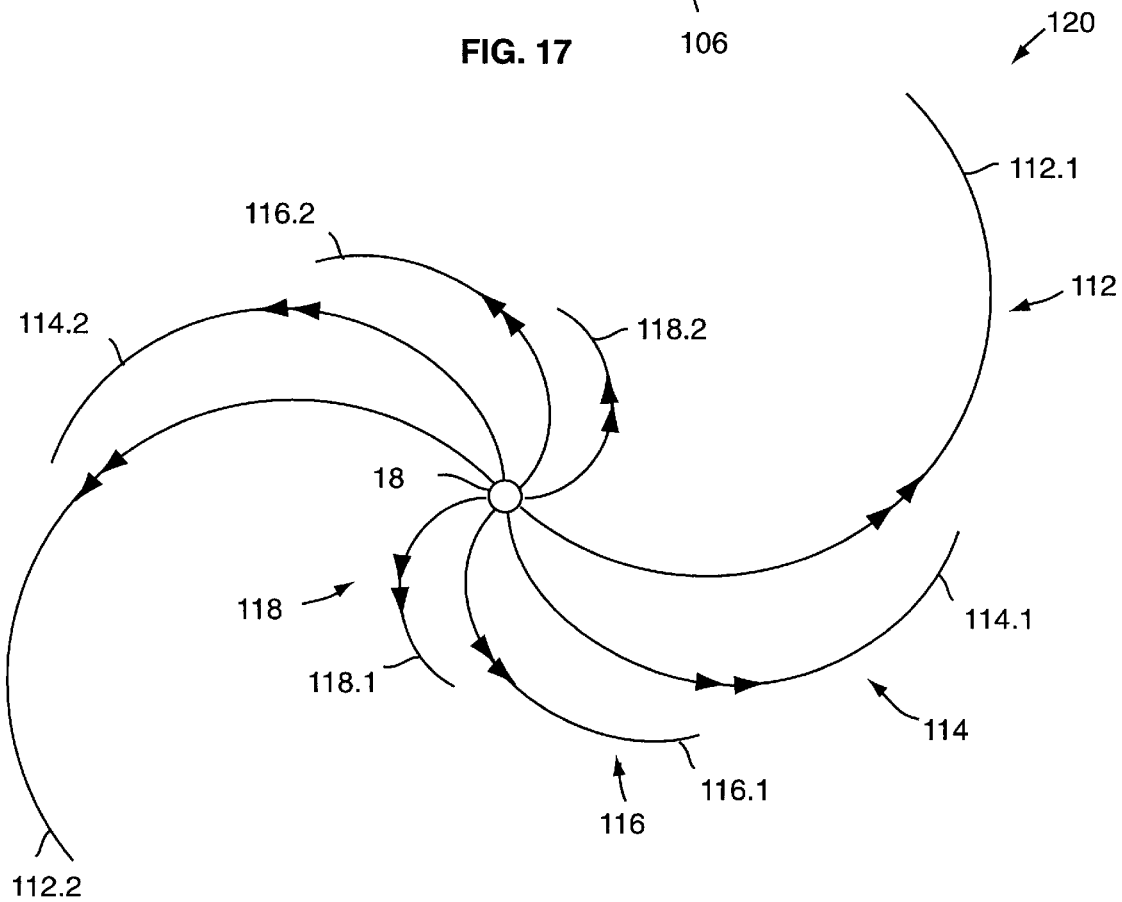
FIG. 18 illustrates yet another embodiment of the instant invention, comprising a plurality of magnetic current elements in accordance with FIG. 3, each with various associated resonant frequencies.

Referring to FIG. 18, a plurality of magnetic dipole antennas 112, 114, 116, and 118, each having a distinct resonant frequency, may be combined with respective signal connectors 18 connected in parallel so as to form a single broadband antenna system 120.

Figure 19:
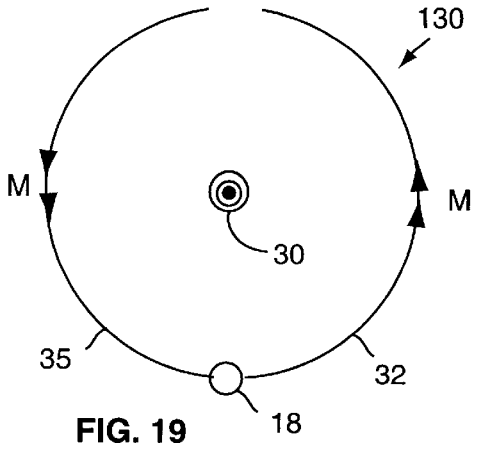
FIG. 19 is a schematic representation of a second elementary embodiment of the instant invention comprising a symmetrical magnetic dipole antenna.

Referring to FIG. 19, a second elementary embodiment of the instant invention comprises a symmetrical magnetic dipole antenna 130 for which the associated magnetic dipole elements 32, 35 are located on a generalized toroid wherein the associated magnetic currents within each magnetic dipole element 32, 35 are directed so as to each have a common direction of circulation 30. Whereas the magnetic dipole elements 32, 35 are illustrated as superimposed on a generally closed form, such as a circle, alternately, the respective magnetic dipole elements 32, 35 can be angulated relative to each other. For example, magnetic dipole element 32 can be rotated clockwise relative to signal connector 18 while magnetic dipole element 35 remains stationary or is rotated counter-clockwise relative to signal connector 18. Alternately, magnetic dipole element 32 can be rotated counter-clockwise relative to signal connector 18 while magnetic dipole element 35 remains stationary or is rotated clockwise relative to signal connector 18.

Figure 20A:
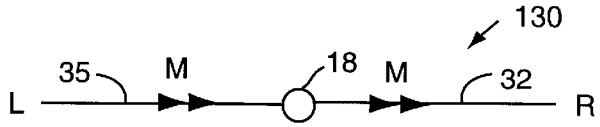
FIG. 20*a* illustrates the embodiment of FIG. 19 projected along a line.
Figure 20B:
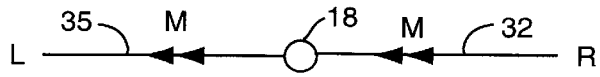
FIG. 20*b* illustrates the embodiment of FIG. 20*a* at a point in time when the signal phases are reversed with respect to that for FIG. 20*a*.

FIG. 20*a* illustrates the embodiment of FIG. 19 projected along a line, for use as a reference for illustrating associated structures and distributions of electric and magnetic currents of various embodiments of the instant invention. FIG. 20*a* illustrates the direction of magnetic current M in the associated magnetic dipole elements 32, 35 at the same instant of time as is illustrated by FIG. 19. As described in the '609 Application, magnetic current corresponds to a time varying magnetic field. FIG. 20*b* illustrates the direction of magnetic current M in the associated magnetic dipole elements 32, 35 at an instant of time when the signal phase is reversed with respect to that of FIG. 20*a*. Accordingly, FIGS. 20*a* and 20*b* illustrate the magnetic current distribution necessary to carry out the embodiment of the instant invention as illustrated by FIG. 19.

Figure 21A:
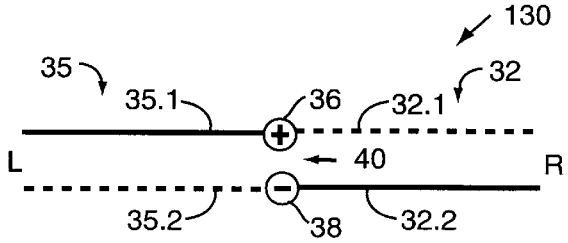
FIG. 21*a* is a schematic representation of a contrawound helical element in accordance with the embodiments of FIGS. 19, 20*a*, and 20*b*.

Referring to FIG. 21*a*, one embodiment of a contrawound helical antenna 130 in accordance with FIGS. 19, 20*a*, and 20*b* is schematically illustrated as a parallel/transmission line fed contrawound helix comprising a pair of isolated conductors. This is further illustrated in FIG. 21*b* as a pair of helical dipole antennas that are relatively contrawound with respect to one another. Each associated helical dipole antenna comprises a pair of helical dipole elements 32.1, 35.2 and 32.2, 35.1 respectively, each contrawound with respect to the other. Viewed in another way, the contrawound helical antenna 130 comprises a pair of magnetic dipole elements 32, 35. One of the magnetic dipole elements 32 comprises a contrawound helix comprising the combination of right-hand 32.1 and left-hand 32.2 pitch sense generalized helix elements. Similarly, the other of the dipole elements 35 comprises a contrawound helix comprising the combination of right-hand 35.2 and left-hand 35.1 pitch sense generalized helix elements. The magnetic dipole elements 32, 35 are fed from a signal source connected to a common pair of nodes 36, 38 comprising a signal input port 40, wherein opposite helix pitch sense helix elements 32.1, 35.1 are connected to one of the nodes 36, and associated helix elements 32.2, 35.2—relatively contrawound to helix elements 32.1, 35.1—are connected to the other of the nodes 38.

Figure 21B:
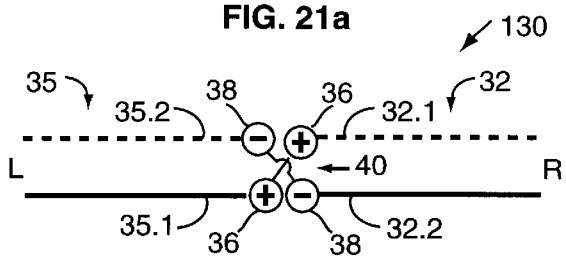
FIG. 21*b* is an equivalent schematic representation of the embodiment of FIG. 21*a* as a combination of two helical dipole elements.
Figure 25A:
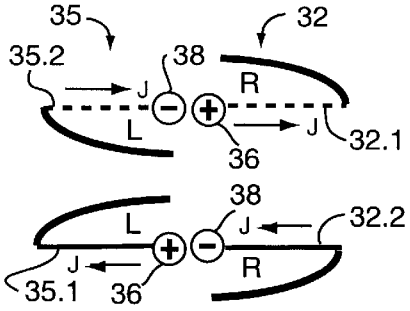
FIG. 25*a* is a representation of the electric current distribution at a given point in time for the embodiment of FIGS. 21*a* and 21*b* for a first order resonance condition.
Figure 25B:
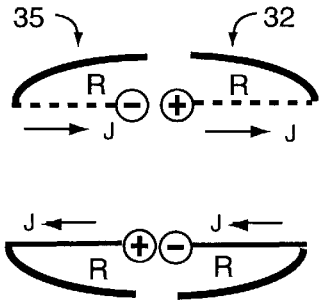
FIG. 25*b* is a representation of the electric current distribution at a given point in time for the embodiment of FIGS. 21*a* and 21*b* for a first order resonance condition, wherein the polarities are referenced to a common direction.
Figure 25C:
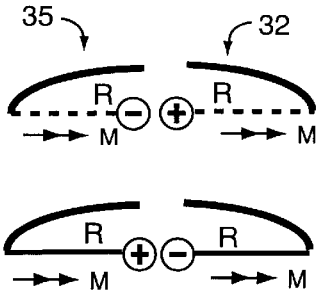
FIG. 25*c* is a representation of the magnetic current distribution at a given point in time for the embodiment of FIGS. 21*a* and 21*b* for a first order resonance condition, wherein the polarities are referenced to a common direction.

FIGS. 25*a*, 25*b*, and 25*c* illustrate the electric J and magnetic M current distributions at the associated fundamental resonant frequency for the embodiments of FIGS. 21*a*, 21*b*, overlaid upon the physical schematic of FIG. 21*b*. Referring to FIG. 25*a*, at a given instant in time, a sinusoidal positive electric current propagates leftwards from node 36 on helical dipole element 35.1, and also rightwards from node 36 on helical dipole element 32.1. Moreover, a sinusoidal negative electric current propagates leftwards from node 38 on helical dipole element 35.2, and also rightwards from node 38 on helical dipole element 32.2. Referring to FIG. 25*b*, the conductor directed electric currents of FIG. 25*a* are transformed into equivalent rightwards directed currents, whereby a negative leftwards directed current becomes a positive rightwards directed current and a positive leftwards directed current becomes a negative rightwards directed current. Finally, FIG. 25*c* illustrates the associated magnetic current M distribution corresponding to the electric current J distributions of FIGS. 25*a* and 25*b*, wherein the directions of electric J and magnetic M current are the same as one another for a right-hand pitch sense helical dipole elements 32.1, 35.2 and are opposite one another for a left-hand pitch sense helical dipole elements 32.2, 35.1, whereby the magnetic currents M for both helical dipole elements 32.1, 32.2 of magnetic dipole element 32 are directed in the same direction. Similarly, the magnetic currents M for both helical dipole elements 35.1, 35.2 of magnetic dipole element 35 are directed in the same direction that is the same as the direction of magnetic current in magnetic dipole element 32. As seen in FIG. 25*b*, the electric current J components on each respective helical dipole element cancel one another. Accordingly, the magnetic dipole antenna 130 operating at the fundamental resonant frequency in accordance with the embodiment of FIGS. 21*a* and 21*b* produces an associated magnetic current M distribution in accordance with FIG. 20*a*, without an appreciable associated electric current J.

Figure 22:
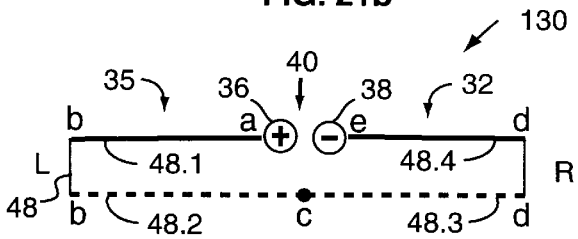
FIG. 22 is a schematic representation of another contrawound helical element in accordance with the embodiments of FIGS. 19, 20*a*, and 20*b*.

Referring to FIG. 22, another embodiment of a contrawound helical antenna 130 in accordance with FIGS. 19, 20*a*, and 20*b* is schematically illustrated as series/loop fed contrawound helix comprising a single conductor 48 constituting a pair of magnetic dipole elements 32, 35. Magnetic dipole element 32 comprises a generalized contrawound helix comprising a right-hand pitch sense helix 48.3 and a left-hand pitch sense helix 48.4, each connected to one another at the right end d. Magnetic dipole element 35 comprises a generalized contrawound helix comprising a right-hand pitch sense helix 48.2 and a left-hand pitch sense helix 48.1, each connected to one another at the left end b. End a of right-hand pitch sense helix 48.1 is connected to node 36 that is operatively coupled to one of the signal terminals. End e of left-hand pitch sense helix 48.4 is connected to node 38 that is operatively coupled to the other of the signal terminals. The remaining free ends of right-hand pitch sense helix 48.2 and right-hand pitch sense helix 48.3 are connected to one another at point c.

Figure 26:
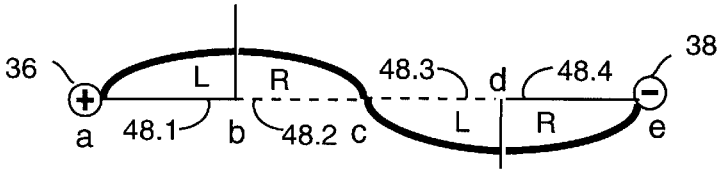
FIG. 26 is a representation of the electric current distribution at a given point in time for the embodiment of FIG. 22, wherein the associated conductor is developed along a line.

Referring to FIG. 26 that illustrating the single conductor 48 projected along a line at a given instant in time for which the sinusoidal waveform applied to nodes 36 and 38 is polarized as shown, the electric current J distribution on the single conductor 48 is a standing wave of one wavelength. The direction of the current within each quarter-wave helix element 48.1, 48.2, 48.3, and 48.4 is shown as left L or right R in accordance with the geometry of FIG. 22.

Figure 27A:
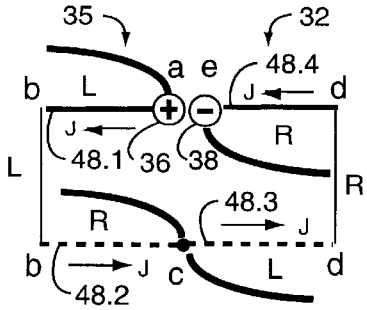
FIG. 27*a* is a representation of the electric current distribution at a given point in time for the embodiment of FIG. 22.
Figure 27B:
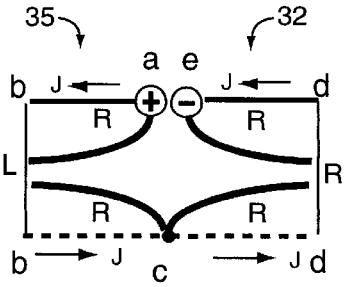
FIG. 27*b* is a representation of the electric current distribution at a given point in time for the embodiment of FIG. 22, wherein the polarities are referenced to a common direction.
Figure 27C:
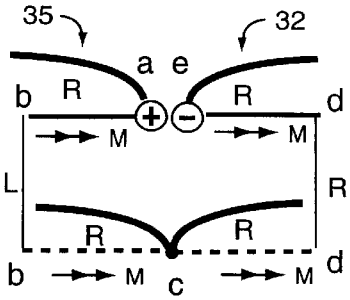
FIG. 27*c* is a representation of the magnetic current distribution at a given point in time for the embodiment of FIG. 22, wherein the polarities are referenced to a common direction.

FIGS. 27*a*, 27*b*, and 27*c* illustrate the electric J and magnetic M current distributions at the associated first harmonic resonant frequency for the embodiment of FIG. 22, overlaid thereupon. Referring to FIG. 27*a*, at a given instant in time, a sinusoidal positive electric current propagates leftwards from node 36 on helix element 48.1 to point b, and then rightwards from point b on helix element 48.2 to point c, a node of the sinusoidal current distribution.

Moreover, a sinusoidal negative electric current propagates rightwards from node 38 on helix element 48.4 to point d, and then leftwards from point d on helix element 48.3 to point c. Referring to FIG. 27*b*, the conductor directed electric currents of FIG. 27*a* are transformed into equivalent rightwards directed currents, whereby a negative leftwards directed current becomes a positive rightwards directed current and a positive leftwards directed current becomes a negative rightwards directed current. Finally, FIG. 27*c* illustrates the associated magnetic current M distribution corresponding to the electric current J distributions of FIGS. 27*a* and 27*b*, wherein the directions of electric J and magnetic M current are the same as one another for a right-hand pitch sense helix elements 48.2, 48.3 and are opposite one another for a left-hand pitch sense helix elements 48.1, 48.4, whereby the magnetic currents M for both helix elements 48.3, 48.4 of magnetic dipole element 32 are directed in the same direction. Similarly, the magnetic currents M for both helix elements 48.1, 48.2 of magnetic dipole element 35 are directed in the same direction that is the same as the direction of magnetic current in magnetic dipole element 32. As seen in FIG. 27*b*, the electric current J components on each respective adjacent helix elements cancel one another. Accordingly, the magnetic dipole antenna 130 operating at the first harmonic resonant frequency in accordance with the embodiment of FIG. 22 produces an associated magnetic current M distribution in accordance with one of the magnetic dipole elements 32, 35 of FIG. 20*a*, without an appreciable associated electric current J.

Figure 23:
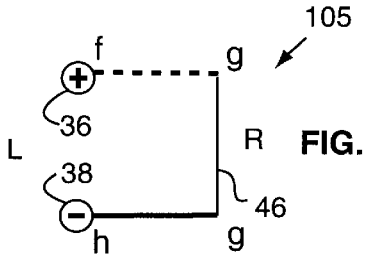
FIG. 23 is a schematic representation of a contrawound helical element in accordance with one of the two magnetic current elements in the embodiments of FIGS. 19, 20*a*, and 20*b*.
Figure 24:
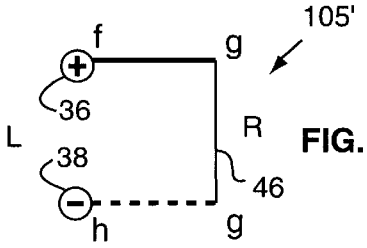
FIG. 24 is a schematic representation of a contrawound helical element in accordance with the other of the two magnetic current elements in the embodiments of FIGS. 19, 20*a*, and 20*b*.
Figure 28:
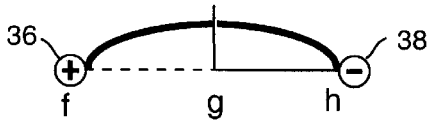
FIG. 28 is a representation of the electric current distribution at a given point in time for the embodiment of FIG. 23, wherein the associated conductor is developed along a line.

A magnetic dipole element in accordance with FIGS. 23 and 24 may be incorporated in the magnetic dipole antenna 130 illustrated in FIG. 19. Accordingly, FIG. 23 is the same as FIG. 11. The magnetic dipole element of FIG. 23 comprises a single conductor 46, which is illustrated in FIG. 28 projected along a line whereupon is overlaid an associated half wavelength standing wave.

Figure 29A:
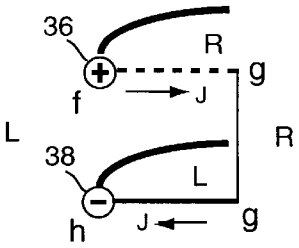
FIG. 29*a* is a representation of the electric current distribution at a given point in time for the embodiment of FIG. 23.
Figure 29B:
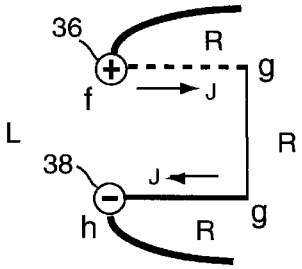
FIG. 29*b* is a representation of the electric current distribution at a given point in time for the embodiment of FIG. 23, wherein the polarities are referenced to a common direction.
Figure 29C:
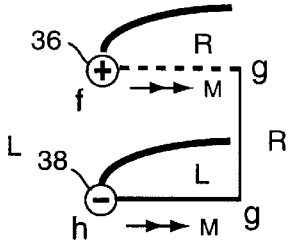
FIG. 29*c* is a representation of the magnetic current distribution at a given point in time for the embodiment of FIG. 23, wherein the polarities are referenced to a common direction.

FIGS. 29*a*, 29*b*, and 29*c* illustrate the electric J and magnetic M current distributions at the associated first harmonic resonant frequency for the embodiment of FIG. 23, overlaid upon the physical schematic of FIG. 23. As for FIGS. 25*a*, 25*b*, and 25*c* described hereinabove, the magnetic dipole element 105 operating at the fundamental resonant frequency in accordance with the embodiment of FIG. 23 produces an associated magnetic current M distribution in accordance with FIG. 20*a*, without an appreciable associated electric current J.

Figure 30:
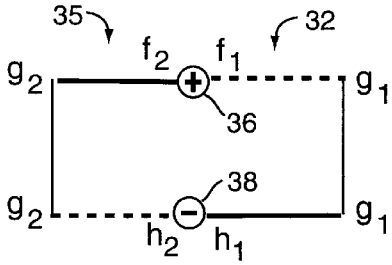
FIG. 30 is a schematic representation of yet another contrawound helical element in accordance with the embodiments of FIGS. 19, 20*a*, and 20*b*, comprising the combination two contrawound helical elements, in accordance with the embodiments of FIGS. 23 and 24.

Referring to FIG. 30, magnetic dipole element 32 in accordance with FIG. 23, is combined in parallel with magnetic dipole element 35 in accordance with FIG. 24 to form a magnetic dipole antenna 130 in accordance with FIGS. 19, 20*a*, and 20*b*, comprising a single conductor formed as a contrawound helix with respective ends shorted together, whereby the signal is parallel/transmission line fed at a signal input port that is across the contrawound helix.

Figure 31A:
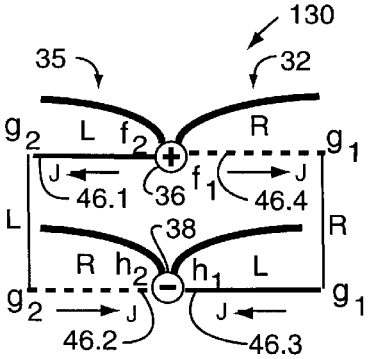
FIG. 31*a* is a representation of the electric current distribution at a given point in time for the embodiment of FIG. 30.
Figure 31B:
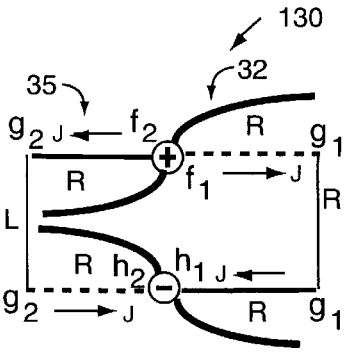
FIG. 31*b* is a representation of the electric current distribution at a given point in time for the embodiment of FIG. 30, wherein the polarities are referenced to a common direction.
Figure 31C:
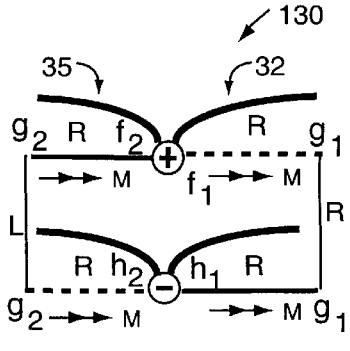
FIG. 31*c* is a representation of the magnetic current distribution at a given point in time for the embodiment of FIG. 30, wherein the polarities are referenced to a common direction.

FIGS. 31*a*, 31*b*, and 31*c* illustrate the electric J and magnetic M current distributions at the associated first harmonic resonant frequency for the embodiment of FIG. 30, overlaid upon the physical schematic of FIG. 30. As for FIGS. 25*a*, 25*b*, and 25*c* described hereinabove, the magnetic dipole antenna 130 operating at the fundamental resonant frequency in accordance with the embodiment of FIG. 30 produces an associated magnetic current M distribution in accordance with FIG. 20*a* , without an appreciable associated electric current J.

Figure 32:
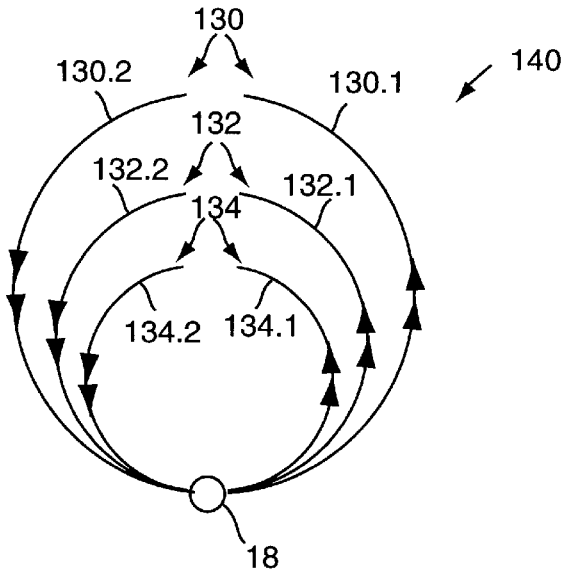
FIG. 32 illustrates yet another embodiment of the instant invention, comprising a plurality of magnetic current elements in accordance with FIG. 19, each with various associated resonant frequencies.

Referring to FIG. 32, a plurality of magnetic dipole antennas 130, 132, and 134, each having a distinct resonant frequency, may be combined with respective signal connectors 18 connected in parallel so as to form a single broadband antenna system 140. This embodiment has the advantage that for each respective magnetic dipole antenna 130, 132, and 134 operated at a relatively high impedance at the input to the respective signal connectors 18, then the parallel combination will act to direct current to the appropriate antenna element in accordance with the signal frequency. Whereas the embodiment illustrated in FIG. 32 is characterized by an even number of associated magnetic dipole elements 130.1, 130.2, 132.1, 132.2, 134.1, and 134.2, the antenna system 140 may be constructed entirely of elements in accordance with FIG. 23 so as to provide any number of magnetic dipole elements—even or odd—in the antenna system 140.

Figure 33:
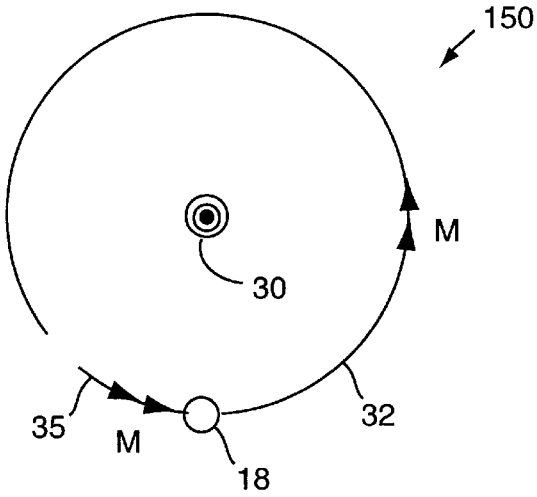
FIG. 33 illustrates yet another embodiment of the instant invention, comprising an embodiment similar to that illustrated in FIGS. 3 or 19, wherein on of the associated magnetic dipole elements has smaller velocity factor that the other.

Referring to FIG. 33, a plurality of magnetic dipole antennas 150 comprises two magnetic dipole elements 32, 35 as in FIG. 19 wherein the velocity factor for one of the magnetic dipole elements 35 is smaller than the velocity factor for the other of the magnetic dipole elements 32.

One of ordinary skill in the art, either by familiarity with existing antenna architectures which produce similar current distributions, or by use of simulations or tests, will be able to appreciate the nature of the electromagnetic radiation patterns and characteristics associated with each of the current distributions illustrated in the drawings.

The various embodiments of the instant invention will have preferable input impedance characteristics, wherein the first resonance will be characterized by high impedance, high bandwidth, and smallest electrical size relative to the next higher resonance order. Each of the embodiments is preferably fed at a single port. An impedance matching network may be required to adapt the resonant impedance of the antenna to that of the associated transmission line.

The antennas are constructed by forming a single conductor around the surface of a real or virtual generalized torus to form a generalized toroidal helical winding, the characteristics of which are taught in the '609 Application. The generalized torus as taught in the '609 Application, and as taught herein, includes both cylindrical toroidal geometries and geometries formed by creating a central core in a sphere, and includes configurations where a portion of the helical winding is primarily radial relative to the major axis of the underlying generalized toroidal form. The generalized torus as taught herein includes the degenerate cases where the major axis is smaller than the minor axis, including cases where the surface is a sphere, cylinder, or prism, and associated image plane embodiments, all of which are illustrated in U.S. Pat. No. 5,654,723.

While specific embodiments have been described in detail, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

I claim:

1. An electromagnetic antenna comprising:

(a) first and second conductors in generalized contrawound helical relation to one another, wherein said first and second conductors arc insulated from one another, said first conductor is divided into first and second portions by a first node, said second conductor is divided into first and second portions by a second node, said first and second nodes are in proximate location to one another and constitute a first port, said first portion of said first conductor is in overlapping relation with said first portion of said second conductor as a first portion of a generalized contrawound helix, said second portion of said first conductor is in overlapping relation with said second portion of said second conductor as a second portion of said generalized contrawound helix, said generalized contrawound helix has an axis having curvature; and (b) a signal feed comprising first and second terminals, wherein said first and second terminals are operatively coupled to said first and second nodes.

2. An electromagnetic antenna as recited in claim 1, wherein the direction of curvature of said axis from said first port within said first portion of said generalized contrawound helix is equal to the direction of curvature of said axis from said first port within said second portion of said generalized contrawound helix.

3. An electromagnetic antenna as recited in claim 1, wherein the direction of curvature of said axis from said first port within said first portion of said generalized contrawound helix is opposite to the direction of curvature of said axis from said first port within said second portion of said generalized contrawound helix.

4. An electromagnetic antenna as recited in claim 1, wherein the helical pitch sense of said first length portion of said first conductor is the same as the helical pitch sense of said second length portion of said first conductor.

5. An electromagnetic antenna as recited in claim 1, wherein the helical pitch sense of said first length portion of said first conductor is opposite to the helical pitch sense of said second length portion of said first conductor.

6. An electromagnetic antenna as recited in claim 1, wherein the distal end of said first length portion of said first conductor is connected to the distal end of said first length portion of said second conductor.

7. An electromagnetic antenna as recited in claim 6, wherein the distal end of said second length portion of said first conductor is connected to the distal end of said second length portion of said second conductor.

8. An electromagnetic antenna, comprising:

(a) a first generalized helical conductive path from a first node to a second node;

(b) a second generalized helical conductive path from a third node to a fourth node, wherein the helical pitch sense of said first generalized helical conductive path is opposite to the helical pitch sense of said second generalized helical conductive path, said first and second generalized helical conductive paths insulated from and overlapping one another so as to constitute a first generalized contrawound helix, and said first generalized contrawound helix has an axis that is curved;

(c) a third generalized helical conductive path from a fifth node to a sixth node;

(d) a fourth generalized helical conductive path from a seventh node to an eighth node, wherein the helical pitch sense of said third generalized helical conductive path is opposite to the helical pitch sense of said fourth generalized helical conductive path, said third and fourth generalized helical conductive paths insulated from and overlapping one another so as to constitute a second generalized contrawound helix, and said second generalized contrawound helix has an axis that is curved; and (e) a signal feed comprising first and second terminals, wherein said first and second terminals are operatively coupled to said first and second generalized contrawound helices.

9. An electromagnetic antenna as recited in claim 8, wherein the direction of curvature of the axis of said first generalized contrawound helix from said first and fourth nodes is the same as the direction of curvature of the axis of said second generalized contrawound helix from said fifth and eighth nodes.

10. An electromagnetic antenna as recited in claim 8, wherein the direction of curvature of the axis of said first generalized contrawound helix from said first and fourth nodes is opposite to the direction of curvature of the axis of said second generalized contrawound helix from said fifth and eighth nodes.

11. An electromagnetic antenna as recited in claim 8, wherein said second node is connected to said third node, said fourth node is connected to said fifth node, said sixth node is connected to said seventh node, and said signal feed is operatively coupled to said first and eighth nodes.

12. An electromagnetic antenna as recited in claim 8, wherein the helical pitch sense of said first conductive path is opposite to the helical pitch sense of said fourth conductive path.

13. An electromagnetic antenna as recited in claim 8, wherein the helical pitch sense of said first conductive path is the same as the helical pitch sense of said fourth conductive path.

14. A method of transmitting an electromagnetic signal, comprising (a) applying a signal to a signal port;

(b) generating a first magnetic current along a first curved path relative to said signal port, responsive to said signal;

(c) generating a second magnetic current along a second curved path relative to said signal port, responsive to said signal.

15. A method of transmitting an electromagnetic signal as recited in claim 14, wherein the direction of curvature of said first and second paths relative to said signal port is the same.

16. A method of transmitting an electromagnetic signal as recited in claim 14, wherein the directions of said first and said second magnetic currents relative to said signal port is the same.

17. A method of transmitting an electromagnetic signal as recited in claim 14, wherein the direction of curvature of said first path relative to said signal port is opposite to the direction of curvature of said second path relative to said signal port.

18. A method of transmitting an electromagnetic signal as recited in claim 14, wherein the directions of said first magnetic current relative to said signal port is opposite to the direction of said second magnetic current.

19. A method of transmitting an electromagnetic signal as recited in claim 14, wherein said first and second magnetic currents are resonant at a first resonant frequency, further comprising:

(a) generating a third magnetic current along a third curved path relative to said signal port, responsive to said signal;

(b) generating a fourth magnetic current along a fourth curved path relative to said signal port, responsive to said signal, wherein said third and fourth magnetic currents are resonant at a second resonant frequency.

20. A method of transmitting an electromagnetic signal as recited in claim 14, wherein a direction of circulation of said first magnetic current is the same as a direction of circulation of said second magnetic current.

21. An electromagnetic antenna comprising:

(a) first and second conductors in generalized contrawound helical relation to one another, wherein said first and second conductors are insulated from one another, said first conductor is divided into first and second portions by a first node, said second conductor is divided into first and second portions by a second node, said first and second nodes are in proximate location to one another and constitute a first port, said first portion of said first conductor is in overlapping relation with said first portion of said second conductor as a first portion of a generalized contrawound helix, said second portion of said first conductor is in overlapping relation with said second portion of said second conductor as a second portion of said generalized contrawound helix, said generalized contrawound helix has an axis, said axis is curved , and the direction of curvature of said axis from said first port within said first portion of said generalized contrawound helix is equal to the direction of curvature of said axis from said first port within said second portion of said generalized contrawound helix; and (b) a signal feed comprising first and second terminals, wherein said first and second terminals are operatively coupled to said first and second nodes.

22. An electromagnetic antenna as recited in claim 21, wherein the helical pitch sense of said first length portion of said first conductor is the same as the helical pitch sence of said second length portion of said first conductor.

23. An electromagnetic antenna comprising:

(a) first and second conductors in generalized contrawound helical relation to one another, wherein said first and second conductors are insulated from one another, said first conductor is divided into first and second portions by a first node, said second conductor is divided into first and second portions by a second node, said first and second nodes are in proximate location to one another and constitute a first port, said first portion of said first conductor is in overlapping relation with said first portion of said second conductor as a first portion of a first generalized contrawound helix, said second portion of said first conductor is in overlapping relation with said second portion of said second conductor as a second portion of said first generalized contrawound helix, said first generalized contrawound helix has a first axis, said first axis is curved, and the direction of curvature of said first axis from said first port within said first portion of said first generalized contrawound helix is opposite to the direction of curvature of said first axis from said first port within said second portion of said first generalized contrawound helix;

(b) third and fourth conductors in generalized contrawound helical relation to one another, wherein said third and fourth conductors are insulated from one another, said third conductor is divided into first and second portions by a third node, said fourth conductor is divided into first and second portions by a fourth node, said third and fourth nodes are in proximate location to one another and constitute a second port, said first portion of said third conductor is in overlapping relation with said first portion of said fourth conductor as a first portion of a second generalized contrawound helix, said second portion of said third conductor is in overlapping relation with said second portion of said fourth conductor as a second portion of said second generalized contrawound helix, said second generalized contrawound helix has a second axis, said second axis is curved, the direction of curvature of said second axis from said second port within said first portion of said second generalized contrawound helix is opposite to the direction of curvature of said second axis from said second port within said second portion of said second generalized contrawound helix, and said first and second ports are proximate to one another; and (c) a signal feed comprising first and second terminals, wherein said first and second terminals are operatively coupled to said first and second nodes and to said third and fourth nodes.

24. An electromagnetic antenna as recited in claim 23, wherein the helical pitch sense of said first length portion of said first conductor opposite to the helical pitch sense of said second length portion of said first conductor, and the helical pitch sense of said first length portion of said third conductor is opposite to the helical pitch sense of said second length portion of said third conductor.

25. An electromagnetic antenna as recited in claim 23, wherein a signal applied to said signal feed produces a first magnetic current in said first portions of said first generalized contrawound helix, said signal applied to said signal feed produces a second magnetic current in said second portion of said first generalized contrawound helix, said signal applied to said signal feed produces a third magnetic current in said first portion of said second generalized contrawound helix, said signal applied to said signal feed produces a fourth magnetic current in said second portion of said second generalized contrawound helix, and said first and second generalized contrawound helices are adapted so that said first, second, third, and fourth magnetic currents have a common direction of circulation.

* * * * *